United States Patent [19]

Mihara et al.

[11] Patent Number: 4,738,733

[45] Date of Patent: Apr. 19, 1988

[54] METHOD FOR HEAT-TREATMENT OF A STRIP

[75] Inventors: Kazumasa Mihara; Takeo Fukushima, both of Hiroshima; Sachihiro Iida; Norihisa Shiraishi, both of Okayama, all of Japan

[73] Assignees: Mitsubishi Jukogyo Kabushiki Kaisha, Tokyo; Kawasaki Steel Corporation, Hyogo, both of Japan

[21] Appl. No.: 1,896

[22] Filed: Jan. 9, 1987

[30] Foreign Application Priority Data

Jan. 9, 1986 [JP] Japan ..... 61-1306

[51] Int. Cl.[4] ..... C21D 11/00

[52] U.S. Cl. ..... 148/128; 148/156

[58] Field of Search ..... 148/128, 153, 155, 156

[56] References Cited

FOREIGN PATENT DOCUMENTS 96824 6/1983 Japan .

74239 4/1984 Japan ..... 266/109

56532 4/1984 Japan ..... 266/109

*Primary Examiner*—Christopher W. Brody

*Attorney, Agent, or Firm*—Wenderoth, Lind & Ponack

[57] ABSTRACT

An improved method for heat-treatment of a strip in a continuous annealing installation in which the strip is heated or cooled by bringing it into contact with a heating or cooling roll having a thermal medium passed there-through. The improvements exist in that on the basis of much experimental data and mathematical analysis, a favorable range for selecting an outer diameter of a heating/cooling roll is determined as a function of various operation parameters.

1 Claim, 3 Drawing Sheets

METHOD FOR HEAT-TREATMENT OF A STRIP

BACKGROUND OF THE INVENTION

The present invention relates to a method for heat-treatment of a strip in a continuous annealing installation.

Various methods for cooling a strip with a cooling roll in a continuous annealing installation have been heretofore proposed. By way of example, in Laid-Open Japanese Patent Specification No. 58-96824 there is disclosed a method for cooling a strip with a cooling roll whose roll diameter fulfills a certain relation. This prior invention relates to a cooling roll for a strip, and according to the invention the roll diameter was determined on the basis of an amount of temperature drop of a strip which is cooled by a single roll. More particularly, it is disclosed that in the case where an amount of cooling with a single roll is 20° C. or less, it becomes difficult to apply the cooling roll to a practical machine because cooling efficiency is poor and hence the number of cooling rolls is increased. Also it is disclosed that in the case where an amount of cooling with a single roll is 150° C. or more, uneven cooling is apt to occur in a strip, and so it is difficult to produce a good strip.

On the basis of such recognition, in Laid-Open Japanese Patent Specification No. 58-96824, a heat transmission model is set up, assuming that an amount of heat released from a strip $Q_s$ and an amount of heat transmission between a strip and a roll $Q_r$ represented by the following Formulae (1) and (2) have equal values, the value of $\Delta T_s$ is substituted in Formula (3), and the relation among a roll outer diameter D, a heat transfer amount K, a strip thickness t and a line speed $L_s$ is defined as represented by Formula (4).

$$Q_s = WltrC_p\Delta T_s \quad (1)$$

$$Q_r = A_sK\Delta T_m t/3600 \quad (2)$$

$$20 < \Delta T_s < 150\ (°C.) \quad (3)$$

$$\frac{104tL_s}{K} < D < \frac{782tL_s}{K} \quad (4)$$

The inventors of this invention repeated experiments more than several hundred times with respect to the method for heating and/or cooling a strip with a roll, similarly to the inventor of the above-referred prior invention, and as a result it was seen that the condition disclosed in Laid-Open Japanese Patent Specification No. 58-96824 was not yet sufficient. For instance, in some cases temperature unevenness occurred in a strip after cooling, or in other cases during cooling, a strip was extremely deformed, resulting in yielding, and corrugation-shaped strain or the so-called cooling buckle was produced.

With regard to the causes of these phenomena, the inventors of this invention analyzed in detail several hundred experimental data for heating and/or cooling by means of a roll, and as a result, it was found that a contact state between a roll and a strip would largely effect the temperature unevenness after cooling (or heating) of the strip and the temperature unevenness is greatly governed by bending of the roll caused by the weight of the roll itself, the weight of thermal medium flowing through the roll and the strip tension.

BRIEF DESCRIPTION OF THE INVENTION

It is therefore one object of the present invention to provide a method for heat-treatment of a strip, in which uneven heating and/or cooling of the strip and deformation of the strip caused by the uneven heating/cooling can by prevented by taking into consideration four essential conditions consisting of plastic deformation of the strip, thermal strain of a roll shell, restriction in view of the strength of the roll shell and restriction in view of heat transmission.

According to one feature of the present invention, in order to achieve the above-mentioned object, there is provided a method for heat-treatment of a strip in a continuous annealing installation, in which the strip is heated or cooled by bringing it into contact with a heating or cooling roll having a thermal medium passed therethrough, characterized in that a roll having a roll outer diameter D and a roll shell thickness $\delta_R$ which fulfil all the relations represented by:

$$\begin{cases} D > \dfrac{1}{2.8} \cdot \dfrac{E \cdot t_{max}}{\sigma_s - UT} \\ D < 6 \times 10^{-3} \dfrac{\ln \dfrac{T_{si} - T_R}{T_{so} - T_R}}{\beta K \left( \dfrac{\delta_R}{2\lambda_R} + \dfrac{1}{\alpha_i} \right)(T_{si} - T_{so})} \\ D^2\delta_R > \dfrac{21}{\sigma_y \pi}(G_1 l_1 + G_2 l_2 + G_3 W)L \\ D < \dfrac{1}{\pi} \cdot K \cdot C_s \cdot t \cdot L_s \cdot l_n \dfrac{T_{si} - T_R}{T_{so} - T_R} \end{cases}$$

is used, where $C_s$ represents a specific heat (kcal/kg°C.) of the strip;

D represents an outer diameter (m) of the roll;

E represents a Young's modulus (kg/m$^2$) of the strip;

$G_1$ represents a weight per unit barrel length (kg/m) of the roll;

$G_2$ represents a weight of thermal medium per unit barrel length (kg/m) of the roll;

$G_3$ represents a tension per unit width (kg/m) of the roll;

K represents a heat transmission rate (kcal/m$^2$h°C.) between the strip and the thermal medium;

L represents a distance (m) that is one-half of the distance between the roll bearings;

$l_n$ represents natural logarithm;

$l_1$ represents a distance (m) that is one-half of the barrel length of the roll;

$l_2$ represents a distance (m) that is one-half of the length in the barrel direction of the thermal medium filling portion of the roll;

$L_s$ represents a line speed (m/h) of the strip;

t represents a thickness (m) of the strip;

$t_{max}$ represents a maximum thickness (m) of the strip to be treated;

$T_{si}$ represents a temperature (°C.) of the strip just before contact with the roll;

$T_{so}$ represents a temperature (°C.) of the strip just after disengagement from the roll succeeding to heat-exchange with the roll;

$T_R$ represents a temperature (°C.) of a thermal medium;

UT represents a unit tension (kg/m$^2$);

W represents a width of the strip;

$\alpha_i$ represents a heat transmission rate (kcal/m$^2$h) between a thermal medium and an inner surface of the roll;

$\beta$ represents a coefficient of linear expansion (1/°C.) of the roll shell;

$\delta_R$ represents a thickness (m) of the roll shell;

$\lambda_R$ represents a thermal conductivity (kcal/mh°C.) of the roll shell;

$\pi$ represents the circular constant;

$\sigma_s$ represents a yield stress (kg/m$^2$) in the strip; and $\sigma_y$ represents a yield stress (kg/m$^2$) in the roll shell.

The above-mentioned and other features and objects of the present invention will become more apparent from the following detailed description of the invention taken in conjunction with the accompanying drawings.

BRIEF DESCRIPTION OF THE DRAWINGS

In the accompanying drawings:

FIG. 2(*b*) is a schematic view showing thermal deformation on an outer surface of a roll;

DETAILED DESCRIPTION OF THE INVENTION

Figure 1:
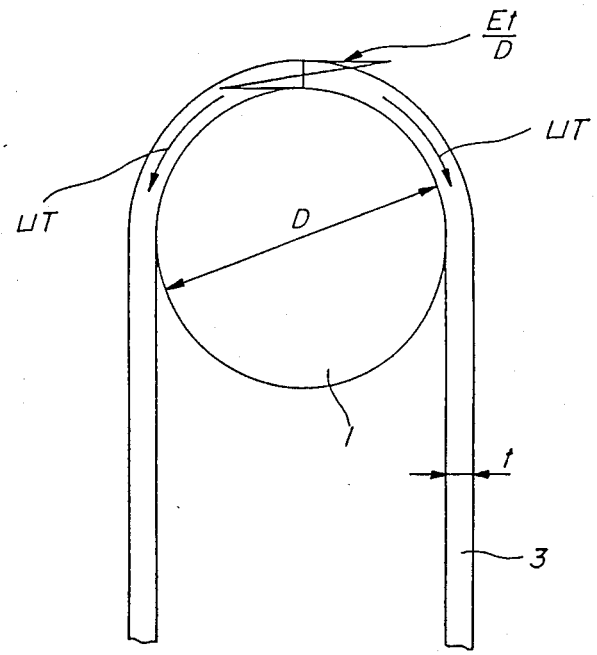
FIG. 1 is a schematic view illustrating unit tension and bending stress acting upon a strip on a roll.

At first, referring to FIG. 1, a condition for a strip 3 on a roll 1 not to be subjected to plastic deformation will be derived. As shown in FIG. 1, the strip 3 is subjected to a tension corresponding to a unit tension UT per unit cross-section area (this unit tension UT being a function of a position in the widthwise direction), and also it is subjected to a bending stress because it is bent along the outer diameter D of the roll. Accordingly, the sum of the tensions exerted upon the outer surface of the strip 3 is equal to (ET/D+DT). The first term in this sum of the tensions is a function of a thickness of the strip, and it increases as the thickness increases. Hence, unless the sum of the stress caused by bending and the unit tension ($Et_{max}$/D+UT) is smaller than a yield stress $\sigma_s$ of the strip 3 even at the maximum thickness $t_{max}$, the strip 3 would be subjected to plastic deformation. In other words, in order to prevent plastic deformation of the strip 3, it is necessary to fulfil the following Formula (5):

$$\frac{Et_{max}}{D} + UT < \sigma_s \tag{5}$$

Resolving this equation with respect to the roll outer diameter D, the following Formula (6) is derived:

$$Et_{max}/(\sigma_s - UT) < D \tag{6}$$

Figure 6:
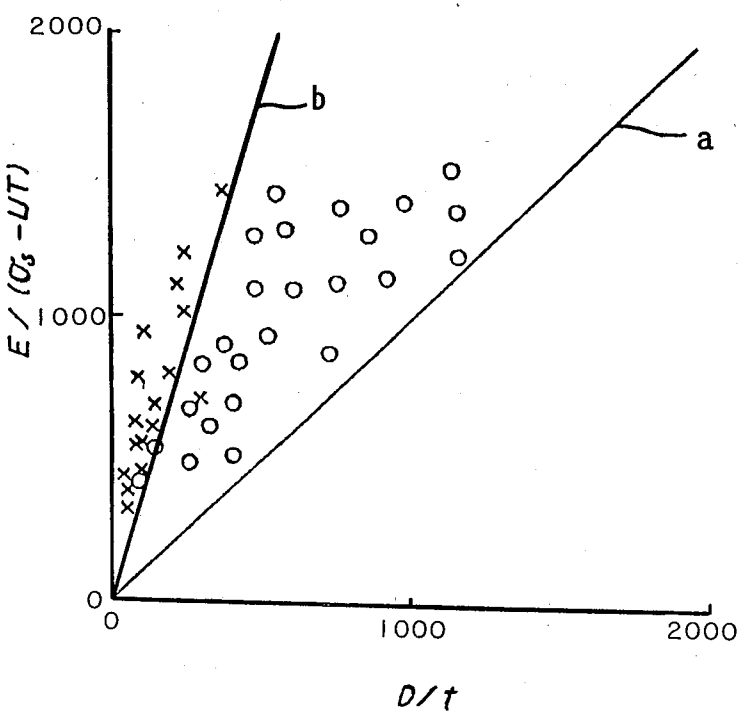
FIGS. 5 and 6, respectively, are graphs showing the results of experiments conducted by the inventors of this invention.

However, as will be apparent from the results of experiments conducted by the inventors of this invention shown in FIG. 6, even if Formula (6) is not fulfilled, under practical operation, plastic deformation of the strip (3) to such extent that there occurs a problem in quality would not arise, and as shown by the following Formula (7), in the range of the roll outer diameter larger than 1/2.8 times the diameter limit in Formula (6), no problem in quality arose under practical operation:

$$Et_{max}/(\sigma_s - UT) < 2.8D \tag{7}$$

It is to be noted that in FIG. 6, the region below straight line a represents the range of the roll outer diameter D fulfilling Formula (6), while the region below straight line b represents the range of the roll outer diameter D fulfilling Formula (7). The marks X in the region above the straight line b represents unfavorable experimental results, and the marks O in the region above the straight line a and below the straight line b represent favorable experimental results.

Figure 2A:
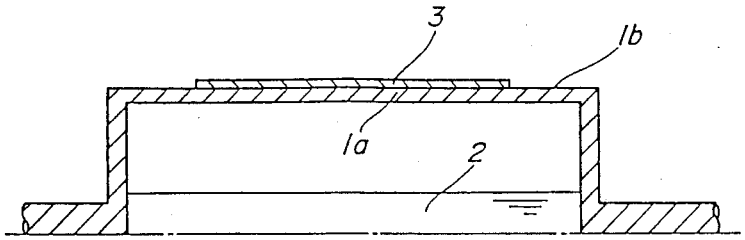
FIG. 2(*a*) is a schematic view showing temperature distribution on a roll shell.
Figure 2B:
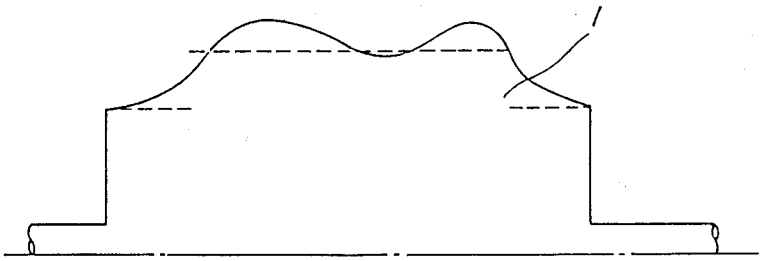

Next, restrictions to the roll shell in view of thermal strain will be explained with reference to FIG. 2. As shown in FIG. 2(*a*), in the case of cooling a strip 3, a roll shell temperature $T_\delta(\delta)$ at the portion 1*a* coming into contact with the strip 3 is higher than a temperature $T_R$ of a coolant 2 and is lower than a temperature $T_s$ of the strip 3 as represented by the following Formula (8):

$$T_s > T_\delta(\delta) > T_R \tag{8}$$

On the other hand, a roll shell temperature $T_\delta'$ at a portion 1*b* not coming into contact with the strip 3 is nearly equal to the temperature $T_R$ of the coolant 3 because the roll outer surface at that portion is nearly in an adiabatic state.

$$T_\delta' \approx T_R \tag{9}$$

As a result, the roll shell expands at the portion 1*a* coming into contact with the strip 3, hence dragging would occur between that portion and the portion 1*b* not coming into contact with the strip 3, and corrugated unevenness would arise on the outer surface of the roll 1 as shown in FIG. 2(*b*). Consequently, portions coming into contact with the roll 1 and the other portions not coming into contact with the roll 1 are produced in the strip 3, and so, uneven cooling would occur. Expressed in a simple form, by employing an arithmatic average temperature of the roll shell temperatures produced by the cooling heat flow as a representative temperature, the following Formulae (10) and (11) are established.

$$\begin{cases} q = K(T_{si} - T_{so})/l_n\,\{(T_{si} - T_R)/(T_{so} - T_R)\} & (10) \\ \Delta D = D \cdot \beta \cdot \dfrac{q}{2}\left(\dfrac{\delta_R}{2\lambda_R} + \dfrac{1}{\alpha_i}\right) & (11) \end{cases}$$

where q represents a heat flow flux (kcal/m$^2$h) between the stip and the thermal medium;

$\lambda_R$ represents a thermal conductivity (kcal/mh°C.) of the roll shell;

$\Delta$D represents a difference in a roll diameter (m) between the portion cooling the strip and the portion not coming into contact with the strip.

According to the results of the experiments conducted by the inventors of the present invention, within the range of the strip width less than 1.8 m it was confirmed that unless the following Formula (12) is fulfilled, the strip would be raised remarkably from the roll and would not be cooled, and hence uneven cooling as well as deformation of the strip, which adversely affect the quality of the final products, would be generated.

$$\Delta D < 3 \times 10^{-3}\ (\mathrm{m}) \tag{12}$$

Therefore, substituting Formula (12) into Formulae (11) and (10), the following formula is derived:

$$D\beta \frac{1}{2} \frac{K(T_{si} - T_{so})}{l_n\{(T_{si} - T_R)/(T_{so} - T_R)\}} \times \left(\frac{\delta_R}{2\lambda_R} + \frac{1}{\alpha_I}\right) < 3 \times 10^{-3}$$

Resolving this formula with respect to D, the following Formula (13) is derived:

$$D < 6 \times 10^{-3} \frac{l_n\{(T_{si} - T_R)/(T_{so} - T_R)\}}{\beta K\left(\frac{\delta_r}{2\lambda_R} + \frac{1}{\alpha_i}\right)(T_{si} - T_{so})} \tag{13}$$

Now, restrictions to the roll shell in view of mechanical strength will be explained with reference to FIG. 3.

Figure 3:
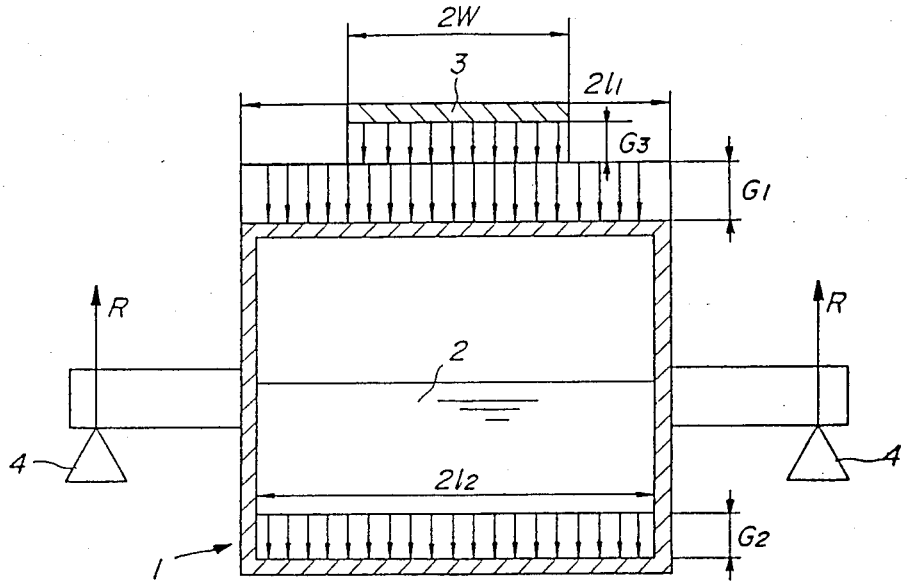
FIG. 3 is a schematic view showing external forces acting upon a roll shell and their distribution.

As shown in FIG. 3, a thermal medium 2 is passed through the interior of the roll 1, and a strip 3 is wound around the outer circumferential surface of the roll 1. Hence, the roll 1 is subjected to its own weight $2G_1l_1$, a weight of the thermal medium $2G_2l_2$ and a strip tension $2G_3W$. Since the roll 1 is supported at its opposite ends by bearings 4, it can be deemed as a simple beam. Hence, assuming that the weight of the roll $2G_1l_1$, the weight of the thermal medium $2G_2l_2$ and the strip tension $2G_3W$ are distributed uniformly between the bearings 4, the maximum bending stress $\sigma$ produced in the roll 1 is calculated by the following Formula (14):

$$\sigma = 16D(G_1l_1 + G_2l_2 + G_3W)L/\{\pi(D^4 - D_i^4)\} \tag{14}$$

If the maximum bending stress $\sigma$ calculated by Formula (14) is smaller than the yield stress $\sigma_y$ of the roll shell, the roll 1 would not be damaged by the above-mentioned three external forces, but this restruction above is insufficient. This is because if the roll 1 is flexed largely by the external forces, the contact condition between the roll 1 and the strip 2 becomes bad, and temperature unevenness would arise in the strip 2. Here, as a result of analysis of the experimental data, it has been found that in order to keep good contact between the roll 1 and the strip 2 along their opposed surfaces, it is necessary to keep the maximum bending stress $\sigma$ smaller than 1/10.5 times the yield stress $\sigma_y$ of the roll shell as represented by the following Formula (15):

$$\sigma_y/10.5 > \sigma \tag{15}$$

In addition, since the inner diameter $D_i$ of the roll can be calculated from the outer diameter D of the roll on the asis of Formula (14) and (15), the thickness $\delta_R$ of the roll shell can be derived from the following Formula (16):

$$\delta_R = (D - D_i)/2 \tag{16}$$

Here, since the thickness $\delta_R$ of the roll shell is generally for smaller than the inner diameter $D_i$ and the outer diameter D of the roll, the following approximation can be made:

$$\sigma_y/10.5 > 16D(G_1l_1 + G_2l_2 + G_3W)\cdot L/\{\pi(D^4 - D_i^4)\} \tag{17}$$

Now, from Formula (16) the following formula can be derived:

$$\begin{aligned} D_i^4 &= (D - 2\delta_R)^4 \\ &= D^4 + 16D^2\delta_R^2 + 16\delta_R^4 + 8D^2\delta_R^2 - 8D^3\delta_R - 24D\delta_R^3 \\ &= D^4 - 8D^3\delta_R + 24D^2\delta_R^3 - 24D\delta_R^3 + 16\delta_R^4 \\ &\approx D^4 - 8D^3\delta_R \end{aligned} \tag{18}$$

($\because$ neglecting the terms of $\delta_R^2$, $\delta_R^3$ and $\delta_R^4$)

Substituting Formula (18) into Formula (17), the following Formula (19) can be derived:

$$\sigma_y/10.5 > 16D(G_1l_1 + G_2l_2 + G_3W)\cdot L/8D^3\delta_R\pi \tag{19}$$

$$D^2\cdot\delta_R > \frac{21}{\sigma_y\pi}(G_1l_1 + G_2l_2 + G_3W)L$$

Figure 4:
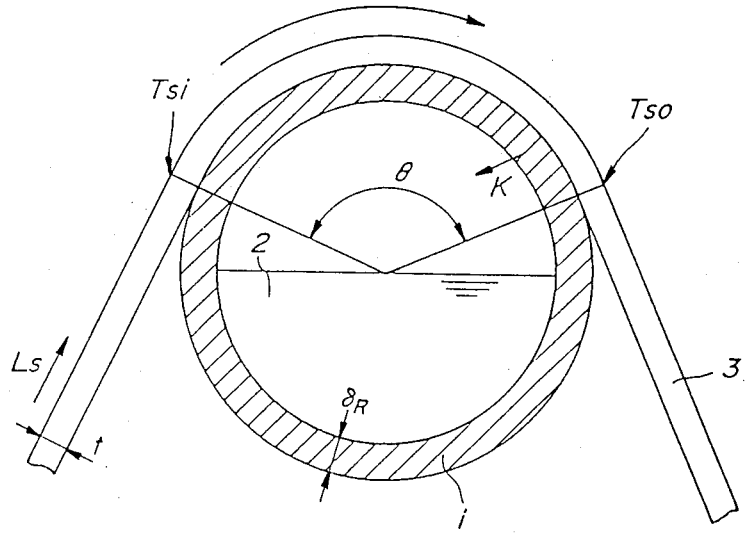
FIG. 4 is a schematic view showing a heat transmitting relation between a roll and a strip.

Finally, restrictions in view of heat transmission will be explained with reference to FIG. 4. FIG. 4 shows a heat transmitting relation in the case of cooling.

Here, the rate of removing heat from the strip 3 is represented by the following Formula (20):

$$Q = C_s\cdot t\cdot W\cdot L_s(T_{si} - T_{so}) \tag{20}$$

Heat transmission between the thermal medium 2 in the roll 1 and the strip 3 is represented by the following Formula (21):

$$Q = KWD\pi\frac{\theta}{360}\cdot\frac{T_{si} - T_{so}}{l_n\frac{T_{si} - T_R}{T_{so} - T_R}} \tag{21}$$

where $\theta$ represents a wrapping angle (degree) of the strip.

In addition, a heat transmission rate K between the strip and the thermal medium is represented by the following Formula (22):

$$K = \left\{\left(\frac{\sigma_1}{\lambda_g} + \frac{\sigma_2}{\lambda_g}\right) + \frac{\theta}{360}\cdot\frac{\delta_R}{\lambda_R} + \frac{\theta}{180}\cdot\frac{1}{\alpha_i}\right\} \tag{22}$$

where $\lambda_g$ represents a thermal conductivity (kcal/mh°C.) of a gas intervening between the strip and the roll;

$\sigma_1$ represents a surface roughness (m) of the strip;

$\sigma_2$ represents an outer surface roughness (m) of the roll shell.

From Formulae (20) and (21), the following Formula (23) can be derived:

$$D < \frac{1}{\pi}\cdot\frac{1}{K}\cdot\frac{360}{\theta}\cdot C_s\cdot t\cdot L_s\cdot l_n\frac{T_{si} - T_R}{T_{so} - T_R} \tag{23}$$

The following Formula (24 is dervied from Formula (23) taking the marginal conditions of the elements into consideration.

$$D < \frac{1}{\pi} \cdot K \cdot C_s \cdot t \cdot L_s \cdot l_n \frac{T_{si} - T_R}{T_{so} - T_R} \quad (24)$$

Now, in the event that through the abovedescribed heat transmission the strip has been, for example, cooled and its temperature has been lowered by $\Delta T_s$, a thermal stress $\sigma_s$ represented by the following Formula (25) occurs:

$$\sigma_s/E = \beta \Delta T_s \quad (25)$$

Whether this thermal stress results in deformation or not, is determined by the restricting condition for the environment as well as the temperature of the strip, and the upper limit temperature change $\Delta T_{scri}$ is approximately 200° C.

DESCRIPTION OF PREFERRED EMBODIMENTS

Figure 5:
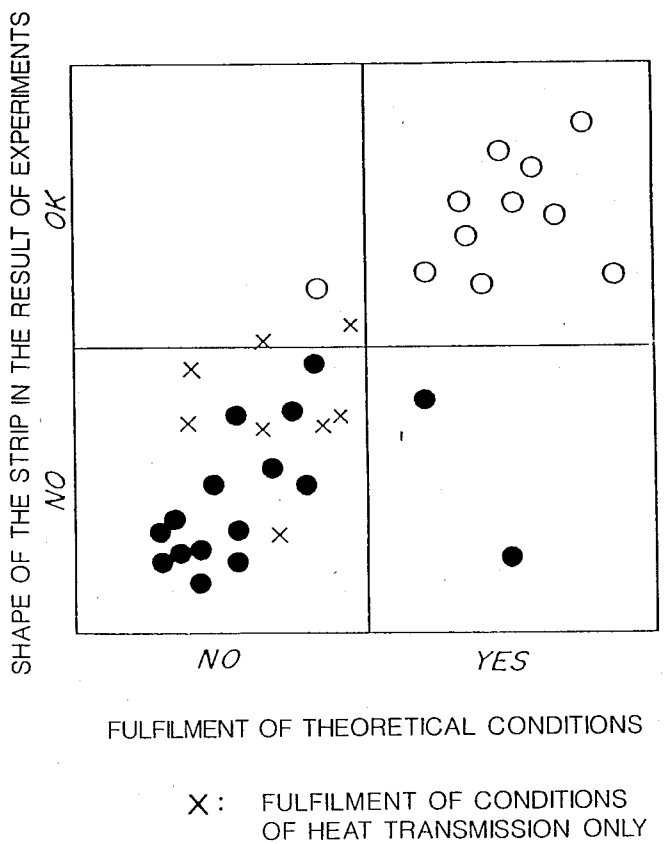

Rolls having diameters $\phi$750 mm and $\phi$1500 mm were employed, and experiments were conducted at K=700, 1000, with respect to strips of 0.5–1.0 t, at a line speed of 200–400 mpm and at a roll contact angle of 20°–120°. The results of experiments are shown in FIG. 5. The strip comes into contact with the roll at 700°–550° C. and leaves the roll at 650°–250° C. As shown in FIG. 5, in the case where the conditions according to the present invention are fulfilled, the shape of the strip becomes good.

As described in detail above in connection with a preferred embodiment, in the method for heat-treatment according to the present invention, since a strip is heated or cooled by employing a roll which is designed taking into consideration four essential conditions consisting of restrictions in view of plastic deformation of a strip, thermal strain of a roll shell, mechanical strength of a roll shell and heat transmission, uneven heating or cooling or deformation of a strip caused by the uneven heating or cooling can be prevented under a condition close to a practical operating condition.

While the principle of the present invention has been described above in connection with preferred embodiments of the invention, it is a matter of course that many apparently widely different embodiments of the invention can be made without departing from the spirit of the present invention.

What is claimed is:

1. A method for heat-treatment of a strip in a continuous annealing installation in which the strip is heated or cooled by bringing it into contact with a heating or cooling roll having a thermal medium passed therethrough, characterized in that a roll having a roll outer diameter D and a roll shell thickness $\delta_R$ which fulfill all the relations represented by the following formulae:

$$\begin{cases} D > \dfrac{1}{2.8} \cdot \dfrac{E \cdot t_{max}}{\sigma_s - UT} \\ D < 6 \times 10^{-3} \dfrac{\ln \dfrac{T_{si} - T_R}{T_{so} - T_R}}{\beta K \left( \dfrac{\delta_R}{2\lambda_R} + \dfrac{1}{\alpha_i} \right)(T_{si} - T_{so})} \\ D^2 \delta_R > \dfrac{21}{\sigma_y \pi} (G_1 l_1 + G_2 l_2 + G_3 W) L \\ D < \dfrac{1}{\pi} \cdot K \cdot C_s \cdot t \cdot L_s \cdot l_n \dfrac{T_{si} - T_R}{T_{so} - T_R} \end{cases}$$

is used where $C_s$ represents a specific heat (kcal/kg°C.) of the strip;
D represents an outer diameter (m) of the roll;
E represents a Young's modulus (kg/m$^2$) of the strip;
$G_1$ represents a weight per unit barrel length (kg/m) of the roll;
$G_2$ represents a weight of a thermal medium per unit barrel length (kg/m) of the roll;
$G_3$ represents a tension per unit width (kg/m) of the roll;
K represents a heat transmission rate (kcal/m$^2$h°C.) between the strip and the thermal medium;
L represents a distance (m) that is one-half of the distance between the roll bearings;
$l_n$ represents natural logarithm;
$l_1$ represents a distance (m) that is one-half of the barrel length of the roll;
$l_2$ represents a distance (m) that is one-half of the length in the barrel direction of the thermal medium filling portion of the roll;
$L_s$ represents a line speed (m/h) of the strip;
t represents a thickness (m) of the strip;
$t_{max}$ represents a maximum thickness (m) of the strip to be treated;
$T_{si}$ represents a temperature (°C.) of the strip just before contact with the roll;
$T_{so}$ represents a temperature (°C.) of the strip just after disengagement from the roll succeeding to heat-exchange with the roll;
$T_R$ represents a temperature (°C.) of a thermal medium;
UT represents a unit tension (kg/m$^2$);
W represents a width of the strip;
$\alpha_i$ represents a heat transmission rate (kcal/m$^2$h) between a thermal medium and an inner surface of the roll;
$\beta$ represents a coefficient of linear expansion (1/°C.) of the roll shell;
$\delta_R$ represents a thickness (m) of the roll shell;
$\lambda_R$ represents a thermal conductivity (kcal/mh°C.) of the roll shell;
$\pi$ represents the circular constant;
$\sigma_s$ represents a yield stress (kg/m$^2$) in the strip; and
$\sigma_y$ represents a yield stress (kg/m$^2$) in the roll shell.

* * * * *